US008363787B2

(12) United States Patent
Lathrop

(10) Patent No.: US 8,363,787 B2
(45) Date of Patent: Jan. 29, 2013

(54) INTERFACE FOR LIQUID METAL BEARING AND METHOD OF MAKING SAME

(75) Inventor: Michael Allan Lathrop, Big Bend, WI (US)

(73) Assignee: General Electric Company, Schenectady, NY (US)

( * ) Notice: Subject to any disclaimer, the term of this patent is extended or adjusted under 35 U.S.C. 154(b) by 183 days.

(21) Appl. No.: 12/716,617

(22) Filed: Mar. 3, 2010

(65) Prior Publication Data

US 2010/0246774 A1 Sep. 30, 2010

Related U.S. Application Data

(63) Continuation-in-part of application No. 12/410,518, filed on Mar. 25, 2009, now Pat. No. 7,933,382.

(51) Int. Cl.
*H01J 35/02* (2006.01)

(52) U.S. Cl. ..... 378/133; 378/132

(58) Field of Classification Search ..... 378/132–133
See application file for complete search history.

(56) References Cited

U.S. PATENT DOCUMENTS

| | | | | |
|---|---|---|---|---|
| 4,210,371 | A | 7/1980 | Gerkema et al. | |
| 5,181,235 | A * | 1/1993 | Ono et al. | 378/133 |
| 5,384,818 | A | 1/1995 | Ono et al. | |
| 5,624,191 | A | 4/1997 | Fuchs et al. | |
| 6,570,110 | B2 | 5/2003 | Narasimhan | |

FOREIGN PATENT DOCUMENTS

| | | | |
|---|---|---|---|
| EP | 00565005 | B1 | 12/1996 |
| WO | 2006046181 | A1 | 5/2006 |

* cited by examiner

*Primary Examiner* — Hoon Song
(74) *Attorney, Agent, or Firm* — Ziolkowski Patent Solutions Group, SC

(57) ABSTRACT

An x-ray tube includes a cathode and a target assembly positioned to receive electrons emitted from the cathode. The target assembly includes a target, and a spiral groove bearing (SGB) configured to support the target. The SGB includes a rotatable component having a first surface and a first material attached to the first surface, a stationary component having a second surface and a second material attached to the second surface, the stationary component positioned such that a gap is formed between the first material and the second material, and a liquid metal positioned in the gap, wherein at least one of the first and second materials comprises tantalum.

7 Claims, 6 Drawing Sheets

INTERFACE FOR LIQUID METAL BEARING AND METHOD OF MAKING SAME

CROSS-REFERENCE TO RELATED APPLICATIONS

The present application is a continuation-in-part of and claims priority to U.S. patent application Ser. No. 12/410,518 filed Mar. 25, 2009.

BACKGROUND OF THE INVENTION

Embodiments of the invention relate generally to x-ray tubes and, more particularly, to an x-ray tube incorporating a spiral groove bearing (SGB) therein.

X-ray systems typically include an x-ray tube, a detector, and a support structure for the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes include a cathode and an anode located within a high-vacuum environment. The anode structure is typically supported by ball bearings and is rotated for the purpose of distributing the heat generated at a focal spot. Typically, an induction motor is employed to rotate the anode, the induction motor having a cylindrical rotor built into a cantilevered axle that supports a disc-shaped anode target and an iron stator structure with copper windings that surrounds an elongated neck of the x-ray tube. The rotor of the rotating anode assembly is driven by the stator. An x-ray tube cathode provides a focused electron beam that is accelerated across an anode-to-cathode vacuum gap and produces x-rays upon impact with the anode. Because of the high temperatures generated when the electron beam strikes the target, it is necessary to rotate the anode assembly at high rotational speed. This places stringent demands on the ball bearings.

A liquid metal bearing may be employed in lieu of ball bearings. Advantages of liquid metal bearings include a high load capability and a high heat transfer capability due to an increased amount of contact area as compared to a ball bearing. Advantages also include low acoustic noise operation as is commonly understood in the art. Gallium and alloys thereof are typically used as the liquid metal, as they tend to be liquid at room temperature and have adequately low vapor pressure, at operating temperatures, to meet the rigorous high vacuum requirements of an x-ray tube.

Gallium tends to be highly reactive and corrosive. Thus, a base metal that is resistant to such corrosion is desirable. As such, a refractory metal such as molybdenum is typically used as the base material for an SGB, and spiral grooves are typically machined in the surface, as known in the art, in order to provide a pumping action to maintain the liquid metal in its desired location. Not only is such material resistant to corrosion, but it tends to be vacuum-compatible and thus lends itself to an x-ray tube application. However, one concern that may be encountered in the use of a liquid metal is that of ensuring adequate wetability of bearing surfaces with the liquid metal. When adequate wetability does not occur, the liquid metal does not completely fill the SGB and the SGB may not uniformly distribute the liquid metal throughout the gap during use, thus shortening the life of the x-ray tube.

Wetability may be negatively affected due to exposure of the base metal to air or moisture prior to and/or during assembly, causing an oxide layer to form thereon. The oxide layer, in turn, deteriorates the wetability of the surface of the part with the liquid metal. Known techniques have been employed to improve or maintain the wetability of the base material under these circumstances. One known technique includes firing the bearing surfaces at approximately 800° C. in hydrogen and then storing the parts in a oxygen-protective atmosphere, like nitrogen or argon, until use. Another known technique includes coating the bearing parts with a carbide, boride, or nitride using, for instance, a physical vapor deposition (PVD) technique.

Another known technique includes applying molybdenum as a diffusion barrier using PVD. However, although molybdenum may be employed when applying such a diffusion barrier using PVD, the base material of the diffusion barrier is typically identical to the base material. Alternatively, materials applied via PVD using materials that differ from the base material tend to be limited to 2000 nm thicknesses for proper application in order to avoid cracking due to thermal mismatch of the applied barrier and the base metal. The thermal mismatch may be mitigated to an extent by employing a coating having an expansion coefficient that is similar to the base metal. However, such solutions tend to limit the number of base metal/coating options. Further, because of the thickness limitation, such materials are precluded from post-machining, thus necessitating that the diffusion barrier be applied having thicknesses that fall within the desired final tolerances of the final part. Also, because of the thickness limitation, such solutions to improve wetability still necessitate that the base material be resistive to the corrosive effects of the liquid metal, such as molybdenum. However, molybdenum tends to be expensive, both as a base material, and in terms of machining and processing.

One technique for minimizing base material expense and improving functionality is to include the preferred base metal (i.e., molybdenum) only in regions that will contact liquid metal. An extension made of a less expensive material may then be brazed or otherwise attached thereto, the extension serving as a mechanical connection as support for an anode. In other words, as an example, a stationary center shaft may support a rotatable support structure having an anode attached thereto. The center shaft may be made entirely of the preferred base metal, or the cost thereof may be reduced by attaching a less expensive steel thereto via a braze or other attachment method, thus reducing the total amount of the preferred base metal. Such a design may result in cost savings because of the less expensive steel portion being used in lieu of the preferred base metal. However, cost savings achieved while using this technique are typically offset to an extent by the additional attachment processing, such as by attaching the extension thereto having a hermetic seal.

One drawback in the use of molybdenum is that molybdenum can form an intermetallic layer with gallium that is not stable at typical operating temperatures of an SGB. Thus, an intermetallic layer tends to form as a result of contact between a solid molybdenum surface and liquid gallium, acting as an abrasive if it tends to break down, or particulate, on contact between stationary and rotating parts, which can lead to early life failure of the SGB. Formation of the intermetallic layer is a function of temperature and follows Arrhenius aging principles as is known in the art.

Thus, an SGB may be built of molybdenum and having gallium as a liquid metal therein, and with proper handling and processing a SGB made as such may provide adequate performance for the life of the x-ray tube. However, a base metal of molybdenum tends to be costly, and an alternative SGB having a molybdenum coating only in regions of contact with gallium typically includes a costly braze step. Machining of molybdenum or a molybdenum coating includes additional costs as well, and an additional wetting step (i.e., firing in a hydrogen environment) is a costly processing step associated with a molybdenum-based SGB. Further, molybdenum forms an intermetallic that is unstable at typical operating temperatures and, as imaging applications tend toward an increase in power, operating temperatures likewise increase, thus accelerating the growth and formation of the molybdenum-gallium intermetallic layer.

Therefore, it would be desirable to have an apparatus and method that reduces total costs associated with fabricating and using an SGB.

BRIEF DESCRIPTION OF THE INVENTION

Embodiments of the invention provide an apparatus and method that overcome the aforementioned drawbacks by providing a material on the surfaces of SGB components.

According to an aspect of the invention, an x-ray tube includes a cathode and a target assembly positioned to receive electrons emitted from the cathode. The target assembly includes a target, and a spiral groove bearing (SGB) configured to support the target. The SGB includes a rotatable component having a first surface and a first material attached to the first surface, a stationary component having a second surface and a second material attached to the second surface, the stationary component positioned such that a gap is formed between the first material and the second material, and a liquid metal positioned in the gap, wherein at least one of the first and second materials comprises tantalum.

In accordance with another aspect of the invention, a target assembly includes a shaft having a first material attached to an outer surface thereof, a sleeve configured to support a target and having a second material attached to an inner surface thereof, and a liquid metal positioned between the first material and the second material, wherein at least one of the first and second materials comprises tantalum.

According to yet another aspect of the invention, a method of manufacturing a target assembly for an x-ray tube comprising the steps of providing a shaft having an outer surface material and having an outer diameter, providing a sleeve having an aperture exposing an inner surface material of the sleeve, wherein a diameter of the inner surface material is greater than the outer diameter of the outer surface material, applying a first layer to the inner surface material, and applying a second layer to the outer surface material. The method further includes acid etching at least one of the first layer and the second layer to remove an oxide therefrom, attaching a target to one of the shaft and the sleeve, inserting the shaft into the sleeve to form a shaft sleeve assembly, and applying a liquid metal to one of the first layer and the second layer of the shaft sleeve assembly.

Various other features and advantages will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
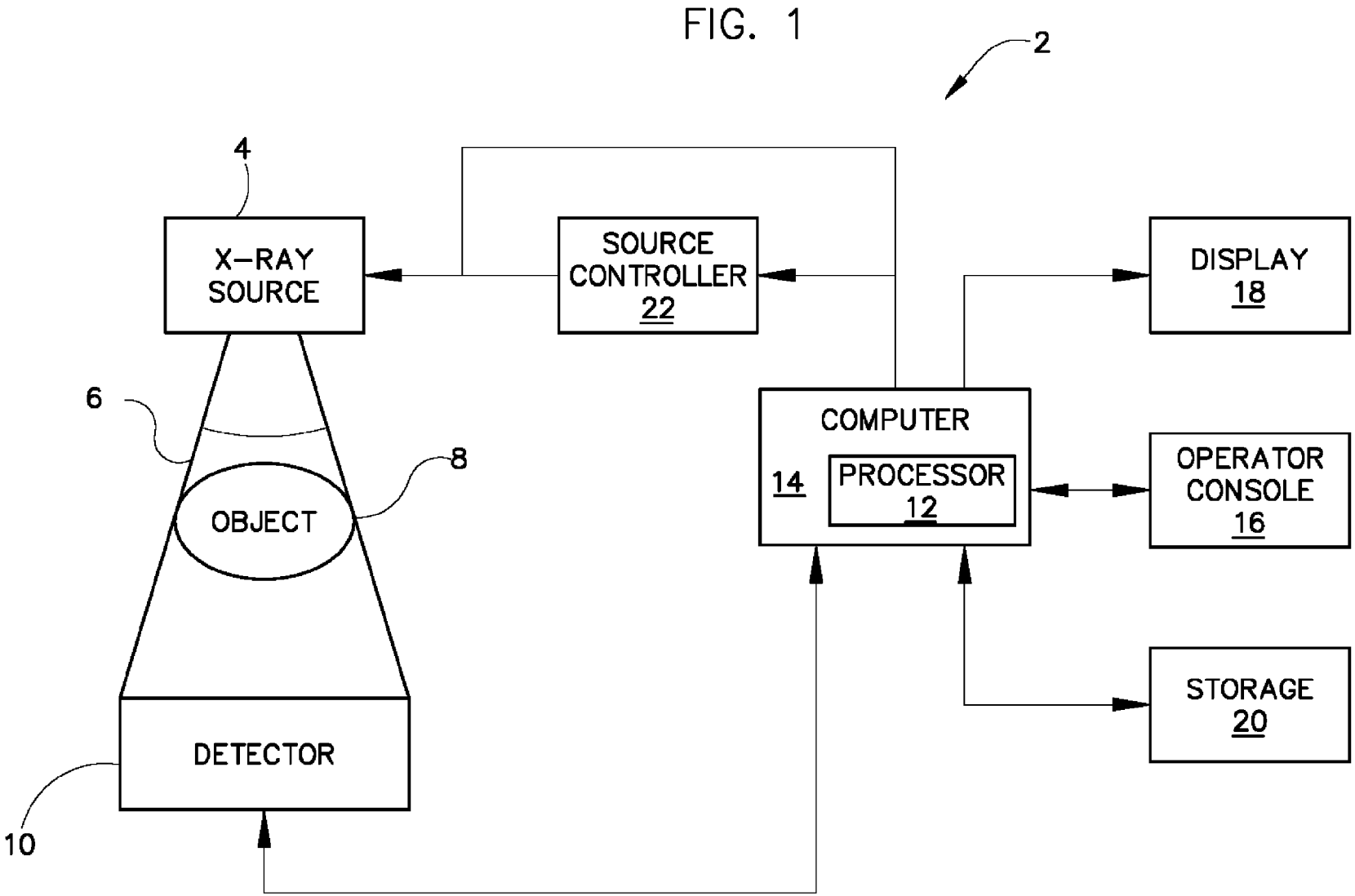
FIG. 1 is a block diagram of an imaging system incorporating embodiments of the invention.

FIG. 1 is a block diagram of an embodiment of an x-ray imaging system 2 designed both to acquire original image data and to process the image data for display and/or analysis in accordance with the invention. It will be appreciated by those skilled in the art that the invention is applicable to numerous medical imaging systems implementing an x-ray tube, such as x-ray or mammography systems. Other imaging systems such as computed tomography (CT) systems and digital radiography (RAD) systems, which acquire image three dimensional data for a volume, also benefit from the invention. The following discussion of imaging system 2 is merely an example of one such implementation and is not intended to be limiting in terms of modality.

As shown in FIG. 1, imaging system 2 includes an x-ray tube or source 4 configured to project a beam of x-rays 6 through an object 8. Object 8 may include a human subject, pieces of baggage, or other objects desired to be scanned. X-ray source 4 may be a conventional x-ray tube producing x-rays having a spectrum of energies that range, typically, from 30 keV to 200 keV. The x-rays 6 pass through object 8 and, after being attenuated by the object 8, impinge upon a detector 10. Each detector in detector 10 produces an analog electrical signal that represents the intensity of an impinging x-ray beam, and hence the attenuated beam, as it passes through the object 8. In one embodiment, detector 10 is a scintillation based detector, however, it is also envisioned that direct-conversion type detectors (e.g., CZT detectors, etc.) may also be implemented.

A processor 12 receives the signals from the detector 10 and generates an image corresponding to the object 8 being scanned. A computer 14 communicates with processor 12 to enable an operator, using an operator console 16, to control the scanning parameters and to view the generated image. That is, operator console 16 includes some form of operator interface, such as a keyboard, mouse, voice activated controller, or any other suitable input apparatus that allows an operator to control the imaging system 2 and view the reconstructed image or other data from computer 14 on a display unit 18. Additionally, operator console 16 allows an operator to store the generated image in a storage device 20 which may include hard drives, flash memory, compact discs, etc. The operator may also use operator console 16 to provide commands and instructions to computer 14 for controlling a source controller 22 that provides power and timing signals to x-ray source 4.

Figure 2:
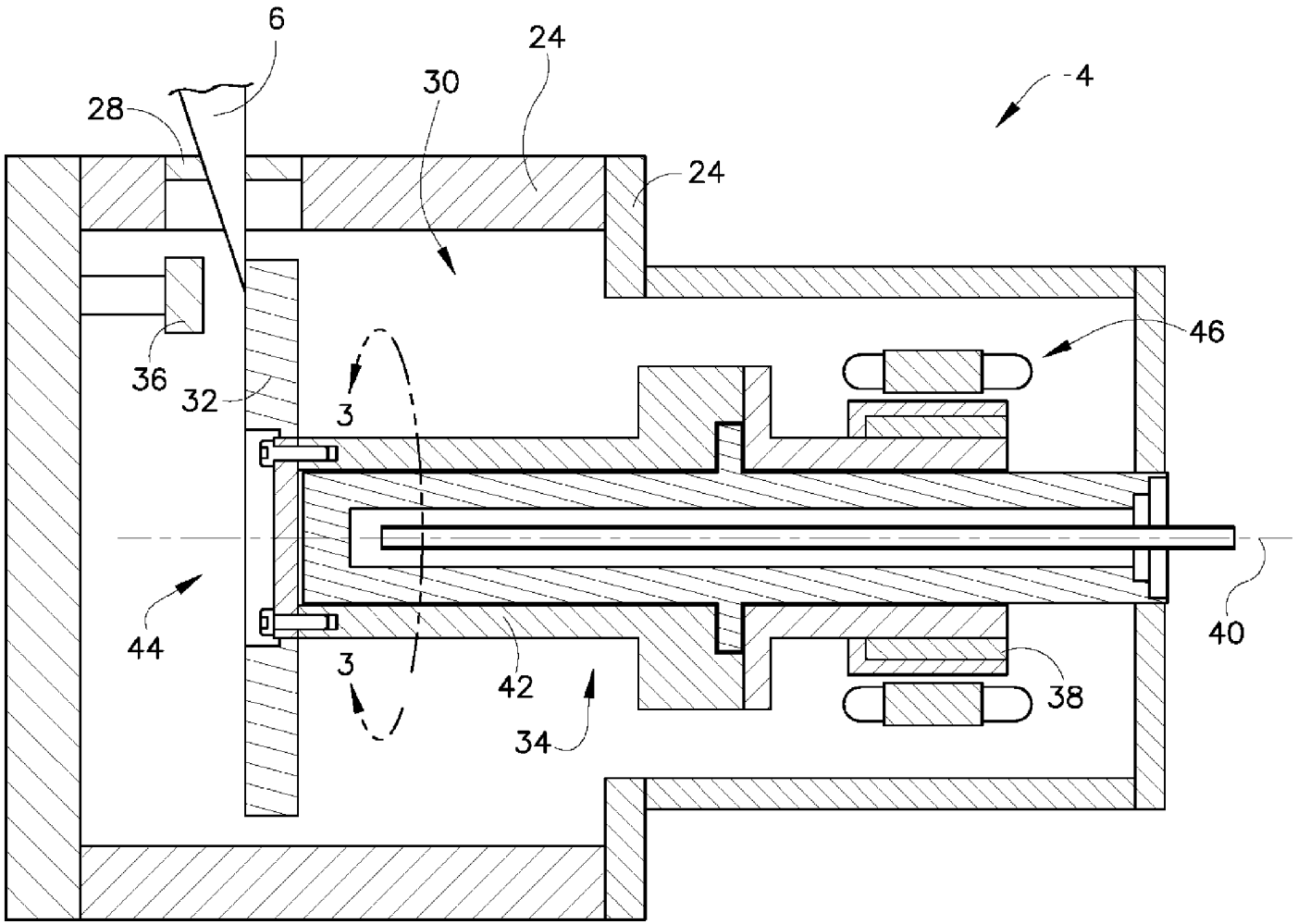
FIG. 2 a cross-sectional view of a portion of an x-ray tube according to an embodiment of the invention and useable with the system illustrated in FIG. 1.

FIG. 2 illustrates a cross-sectional view of x-ray source 4 incorporating embodiments of the invention. The x-ray source 4 includes a frame 24 having a radiation emission passage 28 therein that allows x-rays 6 to pass therethrough. Frame 24 encloses an x-ray tube volume 30, which houses a target or anode 32, a bearing assembly 34, and a cathode 36. The bearing assembly 34 will be described in more detail in FIG. 3.

X-rays 6 are produced when high-speed electrons are suddenly decelerated when directed from the cathode 36 to the anode 32 via a potential difference therebetween of, for example, 60 thousand volts or more in the case of CT applications. The x-rays 6 are emitted through radiation emission passage 28 toward a detector array, such as detector 10 of FIG. 1. To avoid overheating the anode 32 from the electrons, a rotor 38 rotates anode 32 at a high rate of speed about a centerline 40 at, for example, 90-250 Hz. Anode 32 is attached to a sleeve 42 at a first end 44, and rotor 38 is attached to sleeve 42 at a second end 46. In addition to the rotation of anode 32 within x-ray tube 4, in a CT application, the x-ray tube 4 as a whole is caused to rotate about an object, such as object 8 of imaging system 2 in FIG. 1, at rates of typically 1 Hz or faster. Bearing assembly 34 includes a spiral groove bearing (SGB) having adequate load-bearing capability and acceptable acoustic noise levels for operation within imaging system 2.

Figure 3:
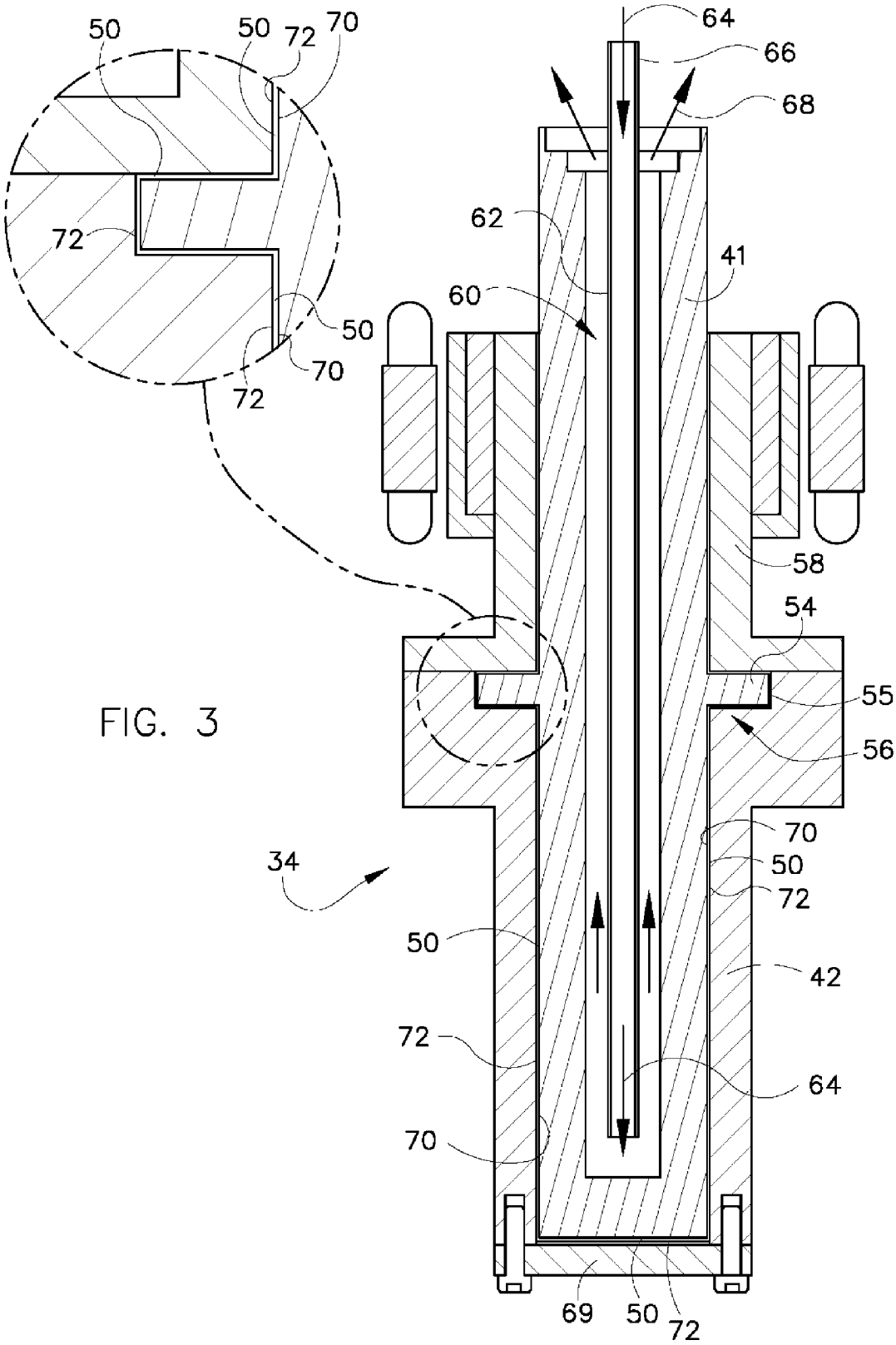
FIG. 3 is a cross-sectional view of a spiral groove bearing (SGB) according to an embodiment of the invention.

Referring now to FIG. 3, a cross-sectional view of an SGB is shown, according to an embodiment of the invention. Bearing assembly 34 includes a center shaft 41 positioned within sleeve 42. Sleeve 42 is configured to support an anode (not shown), such as anode 32 of FIG. 2. Bearing assembly 34 includes a liquid metal 50 positioned between center shaft 41 and sleeve 42. In embodiments of the invention, liquid metal 50 may include gallium and gallium alloys as examples. One skilled in the art will recognize that the invention described herein is applicable to any liquid metal bearing. As is known in the art, center shaft 41 and sleeve 42 typically include helical grooves (not shown) that force liquid metal 50 to remain between center shaft 41 and sleeve 42 during rotation of sleeve 42. As a result, liquid metal 50 remains uniformly distributed about center shaft 41 during rotation of sleeve 42, thus improving its lubricating effects and increasing the load capacity of bearing assembly 34.

As illustrated in FIG. 3, bearing assembly 34 includes a center shaft 41 that, in this embodiment, is stationary, and bearing assembly 34 includes a rotating sleeve 42 configured to attach a target thereto. A liquid metal 50 is positioned between components 41 and 42. One skilled in the art will recognize that other bearing configurations may be included according to embodiments of the invention. As an example, one skilled in the art will recognize that bearing assembly 34 may instead include a stationary outer component and a rotating center shaft having a target attached thereto. As another example, one skilled in the art will recognize that bearing assembly 34 may be a "straddle" bearing that is configured to support a target between a first and a second liquid metal bearing. In other words, embodiments of this invention may be incorporated into any bearing configuration utilizing a liquid metal bearing to support an anode or target. Such configurations may include a stationary center shaft and a rotatable outer shaft, and vice versa. Further, one skilled in the art will recognize that such applications need not be limited to x-ray tubes, but may be applied to any configuration having a rotating component in a vacuum, the rotating component being supported by a liquid metal bearing. Thus, this invention is applicable to any bearing configuration having a rotatable component and a stationary component, and a liquid metal therebetween, regardless of configuration or application.

In one embodiment, center shaft 41 includes a radial projection 54 positioned in a radial cavity 56 of sleeve 42, and sleeve 42 may include a removable cap 58 configured to allow assembly of components. Radial projection 54 limits axial motion of sleeve 42 relative to center shaft 41, and, as illustrated, liquid metal 50 is also included between radial projection 54 and sleeve 42, and between cap 58 and center shaft 41. Radial projection 54 need not be limited in axial length, but may be extended in axial length to provide additional mechanical support of components. In one embodiment, radial projection 54 includes herringbone or helical grooves along an axial surface 55. In another embodiment, radial projection 54 extends over an entire axial length of sleeve 42 of bearing assembly 34. In this embodiment, radial projection 54 takes on a cylindrical shape and is positioned within a cylindrical aperture within sleeve 42. In one embodiment, center shaft 41 includes a cavity 60 passing therethrough and configured to pass a coolant therein. Cavity 60 may include a feed line 62 positioned therein to pass a coolant 64 into cavity 60 at an inlet 66 and then exit therefrom at an outlet 68. As such, coolant 64 enables heat generated from anode 32 of x-ray tube 4 to be extracted therefrom and transferred external to x-ray tube 4. In one embodiment, bearing assembly 34 includes a removable endcap 69.

Center shaft 41, sleeve 42, removable cap 58, and endcap 69 include respective materials or coatings 70, 72 positioned thereon to prevent corrosion of their base material, thus enabling less expensive base materials to be used therein, according to embodiments of the invention. As will be discussed, materials or coatings 70, 72 may be applied as coatings (such as in FIG. 3) or may be separately applied as materials or as separate pieces (such as in FIG. 4). Exemplary base metals for center shaft 41, sleeve 42, removable cap 58, and endcap 69 include refractory metals and alloys thereof, Kovar® (including nickel-cobalt ferrous alloy-based materials), (Kovar® is a registered trademark of Westinghouse Electric and Manufacturing Company, Pittsburgh, Pa.), tool steels (providing good machinability and having a relatively low thermal conductivity), maraging steels (low carbon, ultra-high strength iron alloys known for having superior strength and toughness without losing malleability), iron-nickel (FeNi) alloys, superalloys and Glidcop® (Glidcop® is a registered trademark of SCM Metal Products, Inc, Delaware). In one embodiment an iron-based base metal is used having a chromium content less than 10%. In another embodiment the base metals include 304 or 316 stainless steel.

Tantalum forms an intermetallic layer when in contact with gallium, but it is recognized that tantalum forms a much more high temperature stable intermetallic layer at elevated temperature when compared with molybdenum. Coatings 70, 72 thus comprise tantalum, according to an embodiment of the invention. In another embodiment, tantalum may be combined with another material such as a refractory metal that may include molybdenum or tungsten. Coatings 70, 72 may be applied, according to embodiments of the invention, by molten salt deposition, electroplating, chemical vapor deposition (CVD), physical vapor deposition (PVD), plasma-enhanced PVD (PE-PVD), a laser-enhanced process (such as laser-enhanced net shaping known as LENS®, LENS® is a registered trademark of Sandia Corporation, Albuquerque, N. Mex.), cold spray, sputtering, and combinations thereof. Coatings 70, 72 may be applied in thicknesses selected according to process conditions and desired outcomes, yet each has specific benefits associated therewith. In one embodiment a part to be coated may be masked, as understood in the art, in order that the coating 70 or coating 72 may be applied via, for instance, CVD, to a specific location. In another embodiment, coatings 70, 72 may be applied via, for instance, CVD and then removed via machining or other known removal technique in areas where coatings 70, 72 are not desired.

Referring still to FIG. 3, in embodiments of the invention, coatings 70, 72 are applied that enable a post-machining or post-processing step to be performed thereon prior to final assembly of bearing assembly 34. The post-processing step may be used with any number of material removal techniques commonly known in the art, such as machining, acid-etch, laser etching, electrochemical machining and the like. In such embodiments, coatings 70, 72 are first applied ranging from, for instance, 0.05 to 0.15 mm, to facilitate and enable post-coating processing such that groove production (e.g. due to the machining process) occurs in the coating layer and not in the base metal. Embodiments of the invention include applying coatings 70, 72 to a depth greater than 0.15 mm as well, which may also include a post-machining step. In other words, the coating or material is typically thick enough to enable cutting grooves in the layers or coatings 70, 72 and not in the base metal. In addition, in embodiments that include applying coatings 70, 72 and then performing a post-machining step, one skilled in the art will recognize that initial tolerances of the base material may be relaxed, and that the post-machining step may include higher tolerance fine machining to remove, for instance, 10-30 micron surface pores, thus decreasing the cost of processing by allowing for a lower tolerance part to be fabricated prior to application of coatings 70, 72. According to embodiments of the invention, the post-machining step includes machining spiral grooves in select portions of coatings 70, 72, as is understood in the art, in order to provide a pumping action to maintain liquid metal in a desired location during operation of the SGB. According to one embodiment, the spiral grooves are machined into coatings 70, 72 via electrochemical machining (ECM).

In embodiments, coatings 70, 72 are applied to thicknesses up to 1 mm or thicker. Such processes may include plasma spray, molten salt deposition, LENS®, and cold spray. Because of the thicknesses capable from these processes, the processes likewise support a post-machining process according to the invention by enabling grooves to be cut from the applied material during post-machining Cold spray, for instance, may be used to apply coatings 70, 72 by propelling fine powder particles at high velocities using a compressed gas. The particles are relatively cold, so bulk reaction on impact is in solid state, and there is little to no oxidation. Because the particles typically do not melt during the process, there is relatively little shrinkage upon cooling of the base material. Molten salt deposition may be used to apply coatings 70, 72 to sufficient thicknesses as well. The process includes electrolytic deposition of tantalum in a molten salt mixture. The salt mixture, in embodiments of the invention and as understood in the art, may include NaCl, KCl, and the like. During deposition, as understood in the art, the parts are cathodically polarized and the molten salt typically includes a source of ions of the refractory metal. It is to be recognized that the processes described are but examples for application of coatings according to the invention, and that any number of coating processes may be employed for application of a coating according to the invention.

The LENS® process typically includes a laser consolidation process to impinge and heat a region of a base material to cause the base material to melt. Typically, heat is applied to a base material via one or more lasers sufficiently to cause the base material to melt, and a powdered material (such as a refractory metal) is simultaneously supplied through a feeder to the heated region. Thus, the added material melts and bonds with the underlying material. Because LENS® uses a powder that is fed during the process, the powder may comprise a varying degree of powder components in order to tailor the coating density through its thickness. In other words, as an example, for a tantalum coating on a stainless steel base material such as 304 or 316 stainless, the coating may be applied at the beginning of the process having a low concentration of tantalum and a high concentration of base material. As the process continues during application of the coating, the percentage or concentration of tantalum may be increased while that of the tool steel is decreased, and such change may continue until 100% tantalum is applied.

Other processes, as described above, may likewise be used to apply a graded structure according to embodiments of the invention. In one example, a graded coating may be applied using CVD, by applying multiple layers having varying percentages of materials therein. As is understood in the art, any of the processes described above that are capable of applying a coating or layer having a controlled amount of a mixture may likewise be employed to apply a graded coating through multiple layers by varying the concentrations of components therein, according to embodiments of the invention. In addition, one skilled in the art will recognize that the graded coatings applied may include not only two, but multiple components to apply any number of coatings, according to the invention.

As such, a material may be applied in graded layers of varying concentration of tantalum that results in a gradual change in the thermal expansion coefficient through the thickness of the coating. Because, in this example, the coating near the surface of the base material has a high concentration of base material, it has a thermal expansion coefficient similar to that of the base material. The gradations change to increasing levels of tantalum until 100% tantalum coating is achieved on the outermost portions of the coating. Thus, thermal mismatch is minimized in contiguous portions of the coating, while a desired outer surface has that of tantalum.

Electroplating and CVD may be employed to apply coatings having thicknesses greater than, for instance, 0.1 mm, such as from 0.1 to 2 mm in thickness or greater. Such processes typically support a post-machining process by enabling machining to be performed by cutting grooves entirely from the applied coating while avoiding the base material.

Coatings 70, 72 that include tantalum may be applied having the base material maintained at elevated temperature during the coating process in order to reduce compressive residual stresses in the coatings at operational temperature according to embodiments of the invention. Such an approach would enable a broader mismatch of expansion coefficients of the material being applied to the underlying base material, thus enabling selection of both base and coating materials that differ from one another. In other words, such an approach increases the options for base material/coating combinations based on other desirable product attributes, such as, but not being limited to, thermal conductivity, thermal coefficient of expansion, strength, toughness, cost (both raw materials and processing), and weldability/joinability.

In embodiments of the invention, coating processes may be combined. For instance, although PVD or PE-PVD may not in themselves result in a coating thickness that is sufficient to support a post-machining process, PVD/PE-PVD may be combined with other processes to enhance adhesion of the coatings 70, 72 while enabling low-cost processing and base material options as discussed above. For instance, a base material may first have a coating applied via PVD or PE-PVD, and then a second coating may be applied thereto via, for instance, molten salt deposition or LENS®, as examples, may have improved adhesion, thus coatings 70, 72 may each comprise both the first adhesion layer and the second coating material applied thereto.

Figure 4:
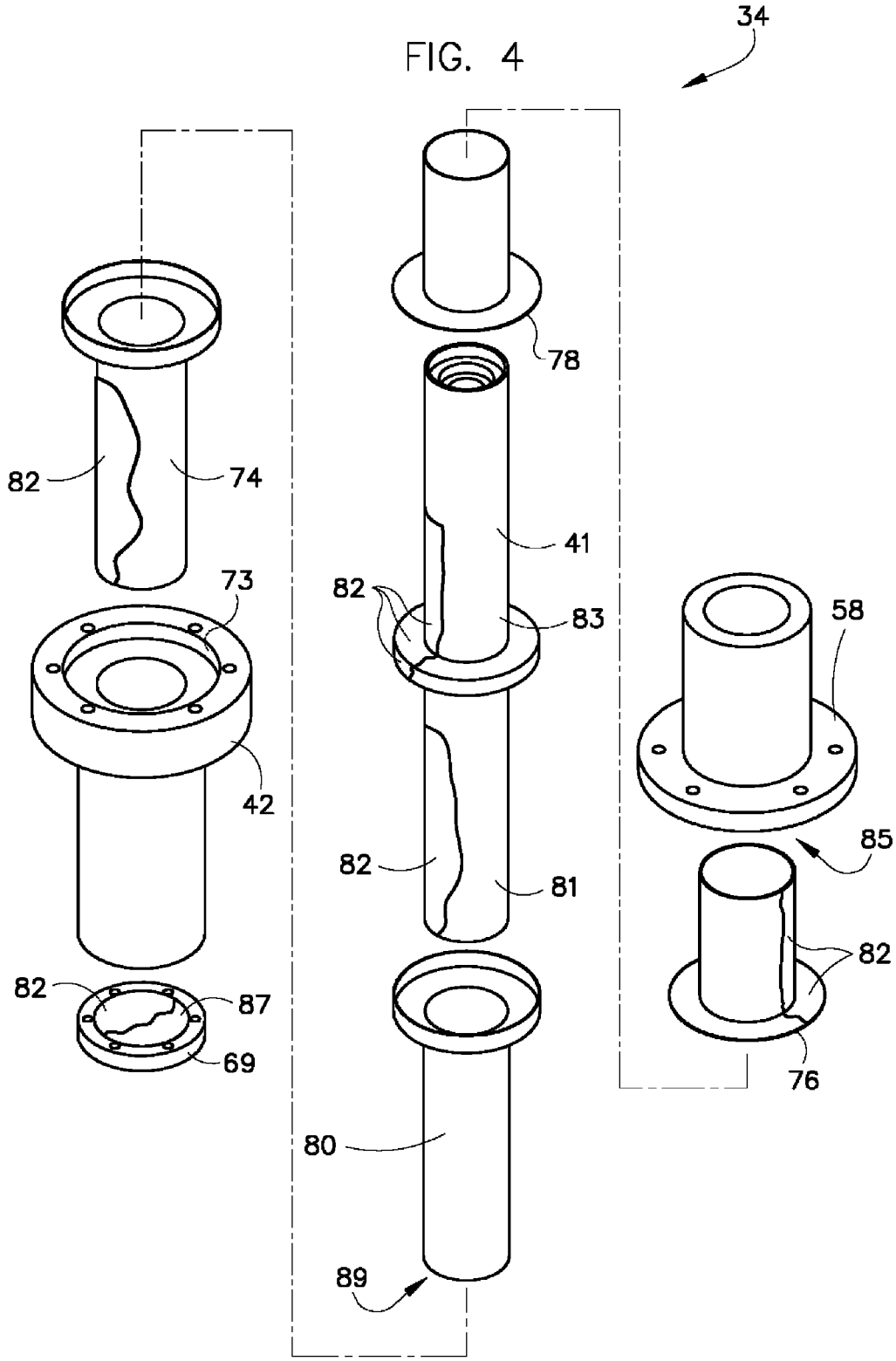
FIG. 4 is a perspective view of material components for a SGB according to an embodiment of the invention.

According to another embodiment of the invention, materials 70, 72 may be preformed from a preferred secondary material or multiple secondary materials and attached to the base material through cladding, brazing, hydroforming, isostatic pressing, rollbonding, rollforming, coextrusion, interference fit, etc. Referring to FIG. 4, bearing assembly 34 includes center shaft 41, sleeve 42, endcap 69, and cap 58. In this embodiment, preformed pieces 74, 76, 78, and 80 are configured to be attached to their respective components as illustrated in FIG. 4. For instance, preformed piece 74 is configured to be attached to an inner diameter 73 of sleeve 42, preformed piece 80 is configured to be attached to an outer diameter 81 of center shaft 41, preformed piece 78 is configured to be attached to outer diameter 83 of center shaft 41, and preformed piece 76 is configured to be attached to an inner diameter 85 of removable cap 58. In one embodiment, preformed piece 80 includes material covering end 89, and in another embodiment endcap 69 includes a preformed material 69 which may be attached to center shaft 41.

Though the preformed pieces 74-80 are shown as being brazed to their respective bearing components, one skilled in the art will recognize that the pieces 74-80 may be bonded or attached via any number of attachment means, such as by welding, soldering, and the like. In embodiments of the invention, the thicknesses of pieces 74-80 are selected to enable post-machining step(s) prior to assembly, and the thicknesses are selected for simplicity of machining, handling, and brazing and are approximately 0.5 mm or greater.

After attachment of pieces 74-80 as applied material, pieces 74-80 are post-machined to obtain desired thicknesses, tolerances, surface qualities, and the like, to obtain a final coating, illustrated as coatings 70, 72 in FIG. 3. As illustrated therein, an optional attachment or bonding material 82 is included that is used to attach pieces 74-80 and 87 to respective base materials center sleeve 42, cap 58, center shaft 41, and endcap 69. And, although pieces 74-80 are illustrated in order to enable assembly of components, one skilled in the art will recognize that more or fewer pieces may be employed according to the invention, depending on the design and a desired set of assembly steps prior to brazing or otherwise attaching the pieces.

Thus, according to embodiments of the invention, materials or coatings 70, 72, (or pieces 74-80 and 87 as illustrated in FIG. 4) may be applied via a number of processes and combination of processes. In embodiments of the invention, materials or coatings 70, 72 that include tantalum may have sufficient thicknesses to enable post-machining of the materials or coatings 70, 72. The materials or coatings 70, 72 may be applied either with specific selection of proper base materials and coating materials to minimize thermal mismatch between components, or may be applied with adjustments to the process itself in order to minimize residual stress during operation. Coating thicknesses may be selected based on a desired life of the coatings, based on the kinetic rate of corrosion that occurs in, for instance, tantalum in the presence of liquid gallium, while taking into account operating temperatures and other factors that impact the rate of corrosion. In one embodiment of the invention, the final thicknesses of materials or coatings 70, 72 are greater than 0.1 mm to provide adequate life of bearing assembly 34 during the life of source 4.

Typically, tantalum may form an oxide layer during processing and during exposure to environmental oxygen, which can reduce wetability of the surface thereof. As with molybdenum, parts coated with tantalum could be hydrogen fired to improve wetability. However, hydrogen firing has been found to embrittle tantalum. Thus, according to an embodiment of the invention, a further process step includes reducing or removing an oxide layer on one or both coatings 70, 72 by selectively plasma etching (i.e., using ionized plasma gases) desired locations.

Figure 5:
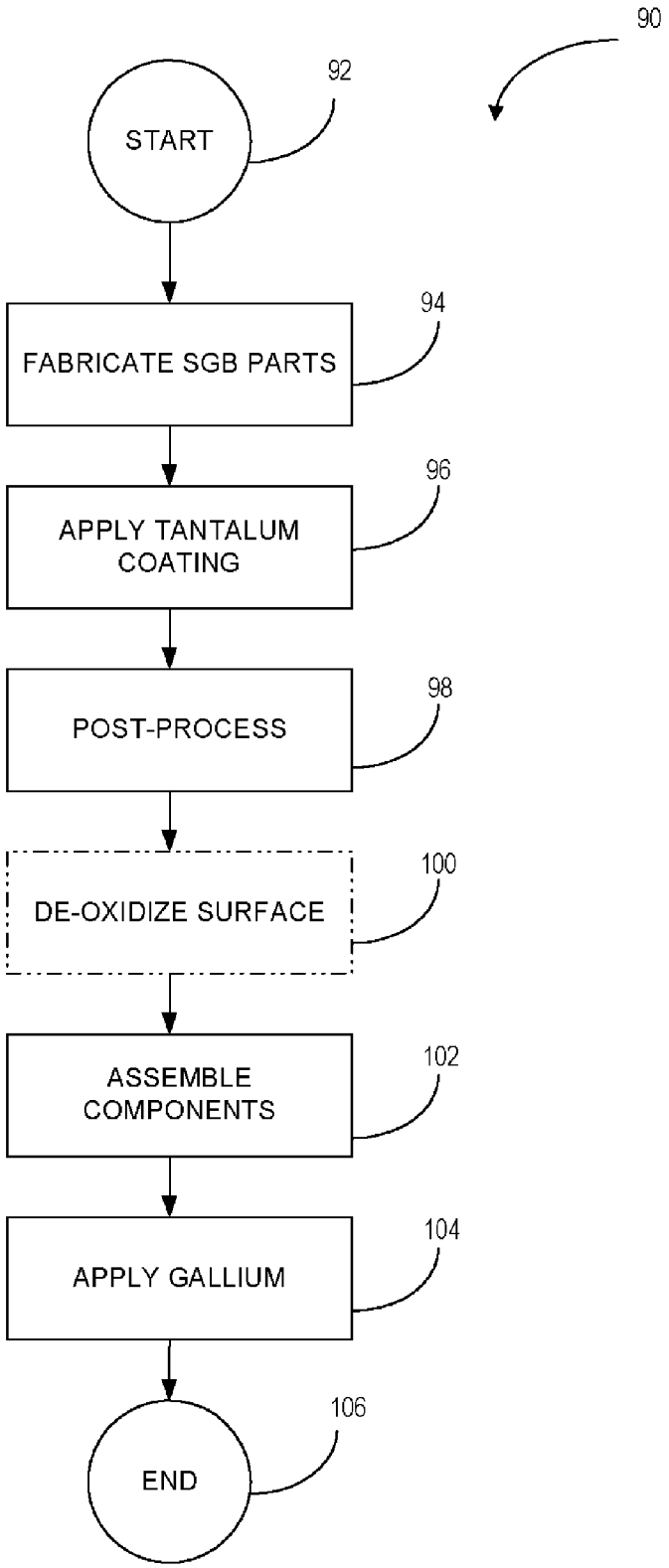
FIG. 5 is a technique for fabricating a SGB, according to an embodiment of the invention.

Referring now to FIG. 5 and according to the discussion above, technique 90 illustrates fabrication of an SGB bearing assembly, such as bearing assembly 34 illustrated in FIG. 3, according to embodiments of the invention. Technique 90 begins at block 92, and SGB parts are fabricated at block 94. For instance, referring to components discussed with respect to FIG. 3, SGB parts fabricated at block 94 include but are not limited to bearing assembly 34 having center shaft 41, sleeve 42, and removable cap 58, as examples. Further, as discussed with respect to FIG. 3, bearing assembly 34 may instead include other configurations, including but not limited to a stationary outer component and a rotating center shaft, or a straddle bearing, as examples. A tantalum coating is applied at block 96 as discussed with respect to coatings 70, 72. That is, parts may have coatings 70, 72 that include tantalum applied as discussed with respect to FIGS. 3 and 4 above, to include embodiments having components with materials 70, 72 applied as coatings (FIG. 3), and to include embodiments having components with materials 70, 72 applied as separate pieces (FIG. 4). Parts are post-processed at block 98. That is, after coatings are applied as described with respect to block 96, parts may be machined, cleaned, measured, tested, and the like, to prepare for assembly and testing as an assembly. Post processing at block 98 may include post-processing and post-machining as discussed above with respect to FIGS. 3 and 4. Optionally, tantalum-coated parts are de-oxidized to improve wetability of coatings 70, 72 at block 100, and in one embodiment, the parts are de-oxidized using plasma etching. Bearing components 34 are assembled at block 102 which may include attaching a target to one of the SGB parts, and building components 34 into an assembly as illustrated with respect to, for instance, FIGS. 3 and 4 above. A liquid metal is applied to bearing assembly 34 at block 104 and as known in the art. Referring to FIG. 3, for example, liquid metal 50 may be applied between coatings 70, 72. In one embodiment liquid metal 50 is applied to components of bearing assembly 34 prior to assembling components 34, while in another embodiment liquid metal is applied after components 34 are assembled. In one embodiment liquid metal 50 is gallium or an alloy thereof. Technique 90 ends at block 106. As understood in the art, once an SGB bearing assembly is fabricated, it may be further tested, processed, and fabricated into a device such as x-ray tube or source 4 illustrated in FIGS. 1 and 2.

Accordingly, because materials or coatings 70, 72 prevent corrosion of the base materials to which they are applied, the base materials selected may be less expensive. And because of the flexibility in material choice, base materials may be selected having improved engineering properties, such as, but not being limited to, thermal conductivity, thermal coefficient of expansion, strength, toughness, cost (both raw materials and processing), and weldability/joinability.

Figure 6:
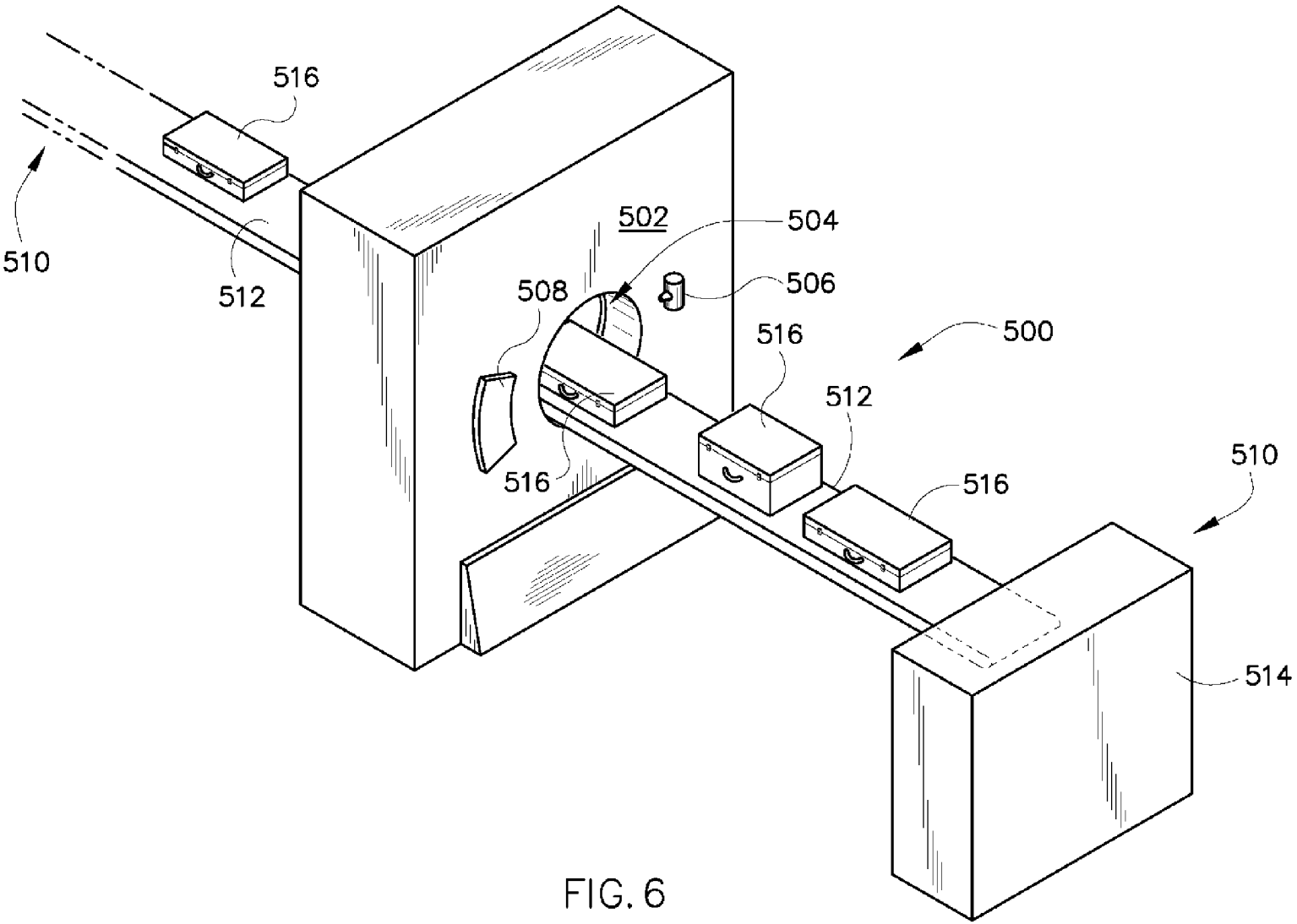
FIG. 6 is a pictorial view of an x-ray system for use with a non-invasive package inspection system.

FIG. 6 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc. One skilled in the art will recognize that gantry 502 may be stationary or rotatable. In the case of a rotatable gantry 502, system 500 may be configured to operate as a CT system for baggage scanning or other industrial or medical applications.

According to an embodiment of the invention, an x-ray tube includes a cathode and a target assembly positioned to receive electrons emitted from the cathode. The target assembly includes a target, and a spiral groove bearing (SGB) configured to support the target. The SGB includes a rotatable component having a first surface and a first material attached to the first surface, a stationary component having a second surface and a second material attached to the second surface, the stationary component positioned such that a gap is formed between the first material and the second material, and a liquid metal positioned in the gap, wherein at least one of the first and second materials comprises tantalum.

In accordance with another embodiment of the invention, a target assembly includes a shaft having a first material attached to an outer surface thereof, a sleeve configured to support a target and having a second material attached to an inner surface thereof, and a liquid metal positioned between the first material and the second material, wherein at least one of the first and second materials comprises tantalum.

According to yet another embodiment of the invention, a method of manufacturing a target assembly for an x-ray tube comprising the steps of providing a shaft having an outer surface material and having an outer diameter, providing a sleeve having an aperture exposing an inner surface material of the sleeve, wherein a diameter of the inner surface material is greater than the outer diameter of the outer surface material, applying a first layer to the inner surface material, and applying a second layer to the outer surface material. The method further includes acid etching at least one of the first layer and the second layer to remove an oxide therefrom, attaching a target to one of the shaft and the sleeve, inserting the shaft into the sleeve to form a shaft sleeve assembly, and applying a liquid metal to one of the first layer and the second layer of the shaft sleeve assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An x-ray tube comprising:
- a cathode; and
- a target assembly positioned to receive electrons emitted from the cathode, the target assembly comprising:
  - a target; and
  - a spiral groove bearing (SGB) configured to support the target, the SGB comprising:
    - a rotatable component having a first surface and a first material attached to the first surface;
    - a stationary component having a second surface and a second material attached to the second surface, the stationary component positioned such that a gap is formed between the first material and the second material;
    - a liquid metal positioned in the gap; and
    - spiral grooves in at least one of the first and second materials, wherein the grooves are not in the one of the rotatable component and the stationary component to which the first and second materials are attached;
- wherein at least one of the first and second materials comprises tantalum, and wherein a thickness of one of the first and second materials is 1 mm or greater.

2. The x-ray tube of claim 1 wherein the stationary component comprises a center shaft and the rotatable component comprises a sleeve, the sleeve having the target attached thereto.

3. The x-ray tube of claim 1 wherein the SGB further comprises:
- a third material positioned between the rotatable component and the first material; and
- a fourth material positioned between the stationary component and the second material.

4. The x-ray tube of claim 3 wherein one of the third material and the fourth material comprises a braze material.

5. The x-ray tube of claim 1 wherein the liquid metal comprises one of gallium and an alloy of gallium.

6. The x-ray tube of claim 1 wherein one of the rotatable component and stationary component comprises one of refractory metal or refractory metal alloys, a superalloy, Kovar®, a tool steel, a FeNi alloy, a maraging steel, Glidcop® and stainless steel.

7. The x-ray tube of claim 1 wherein one of the rotatable component and the stationary component comprises an iron-based material having a chromium content less than 10%.

* * * * *